US005171048A

United States Patent [19]

Weinerman et al.

[11] Patent Number: 5,171,048

[45] Date of Patent: Dec. 15, 1992

[54] VEHICLE DOOR LOCK ASSEMBLY

[75] Inventors: Lee S. Weinerman, Medina; John V. Pastva, Jr., Parma Hts., both of Ohio

[73] Assignee: The Eastern Company, Cleveland, Ohio

[21] Appl. No.: 666,793

[22] Filed: Mar. 8, 1991

Related U.S. Application Data

[63] Continuation-in-part of Ser. No. 665,982, Mar. 7, 1991, and a continuation-in-part of Ser. No. 666,404, Mar. 7, 1991.

[51] Int. Cl.[5] ..... E05C 3/34

[52] U.S. Cl. ..... 292/45; 292/169.11; 292/27

[58] Field of Search ..... 292/27, 53, 45, 169.11, 292/24, 25, 30, 49, 124, DIG. 46

[56] References Cited

U.S. PATENT DOCUMENTS

| | | | |
|---|---|---|---|
| D. 231,723 | 6/1974 | Pastva, Jr. | D8/109 |
| 1,977,853 | 10/1934 | Kemp | 70/103 X |
| 1,983,446 | 12/1934 | Falk | 70/103 |
| 3,532,373 | 10/1970 | Poe | 292/53 X |
| 3,857,594 | 12/1974 | Pastva, Jr. | 292/27 |

OTHER PUBLICATIONS

Eberhard Manufacturing Co. division of The Eastern Company, Eberhard 206 Safety Slam Lock, Apr. 1973, 4 pages, Cleveland, Ohio USA 44136.

U.S. Pat. & Trademark Office, Supplemental Register Trademark Reg. 1,455,909 Registered Sep. 1, 1987, WAshington, D.C. 20231.

Eberhard Manufacturing Co., division of The Eastern Co., The Eberhard 206 Safety Slam Lock System Is More Than Just A Lock, 6 pages, 1978, Cleveland, OH 44136.

Eberhard Manufacturing Co., division of The Eastern Co., Series 206,207,208, 4 pages, 1989, Cleveland, OH 44136.

*Primary Examiner*—Richard E. Moore

*Attorney, Agent, or Firm*—David A. Burge

[57] ABSTRACT

A door lock assembly includes a housing-carried set of interactive operating components for mounting on a closure for releasingly engaging a keeper that is carried by structure located adjacent to an opening through which access is controlled by positioning the closure selectively in open and closed positions. The lock assembly is "slam-capable" in that its operating components include a pair of oppositely pivoted, spring-biased jaws that are movable into latching engagement with the keeper as the closure is closed. The lock housing includes a pair of interfitting, cast metal housing members that cooperate to define a housing assembly that has a keeper-receiving formation along a curved end region thereof. Channel-like central formations are defined on the hollow interior of the housing assembly for mounting operating components that include a pair of opposed jaw members that function to latchingly interengage portions of the keeper when the closure is in its closed position. The central formations define a slide channel that selectively movably mounts one of two embodiments of a stamped slide. In one embodiment, the stamped slide is a one-piece member. In an alternate embodiment, the slide is formed by a pair of snap-together stamped components.

14 Claims, 7 Drawing Sheets

VEHICLE DOOR LOCK ASSEMBLY

CROSS-REFERENCE TO RELATED APPLICATIONS

The present application is a continuation-in-part of two applications filed approximately one day prior to the filing of the present application, the disclosures of both of which are incorporated herein by reference, namely:

DOOR LOCK ASSEMBLY, a utility application of Ser. No. 07/665,982, filed Mar. 7, 1991 by Lee S. Weinerman et al, referred to hereinafter as the "Parent Utility Case;" and, LOCK ASSEMBLY, a design application of Ser. No. 07/666,404, filed Mar. 7, 1991 by Lee S. Weinerman et al, referred to hereinafter as the "Parent Design Case."

BACKGROUND OF THE INVENTION

1. Field of the Invention

The present invention relates to a novel and improved slam-capable door lock assembly that includes a housing-carried set of operating components that latchingly engage a keeper as a closure on which the lock assembly is mounted is moved to its closed position. More particularly, the present invention relates to an opposed-jaw type of double-acting lock assembly that has a two-piece cast metal housing assembly, with the housing-carried operating components including a novel and improved slide member for concurrently operating a set of spring-biased, oppositely pivoted jaws that latchingly engage a suitably configured keeper.

2. Prior Art

Locks are known that employ pairs of opposed, spring-biased bolts for engaging a keeper. By way of example, reference is made to U.S. Pat. No. 3,857,594 issued Dec. 31, 1974 to John V. Pastva, Jr., entitled DOOR LOCK ASSEMBLY, referred to hereinafter as the "Prior Utility Patent," the disclosure of which is incorporated herein by reference; and to U.S. Design Pat. No. 231,723 issued Jun. 4, 1974 to John V. Pastva, Jr., entitled VEHICLE DOOR LOCK, referred to hereinafter as the "Prior Design Patent," the disclosure of which is incorporated herein by reference. The Prior Utility Patent discloses mechanical features of one such lock. The Prior Design Patent relates to external appearance features of one such lock.

While the subject matter of the Prior Utility Patent has provided a well-accepted slam-capable door lock that is well suited for use in what are referred to by those who are skilled in the art as "personnel restraint applications" (e.g., locks for passenger compartment doors of vehicles), a need has arisen for a lighter-duty but similarly configured door lock formed from a lesser number of complexly configured components, with the lighter-duty lock being usable in "non-passenger-restraint" types of applications, typically for controlling access to vehicle storage compartments that are not intended to restrain passengers but rather are used typically to house tools, supplies and the like.

3. The Cross-Referenced Parent Cases

The Parent Utility Case to which reference is made on Page One hereof has in common with the present case the fact that the subjects matter of both of these cases relate to the provision of relatively light-duty lock assemblies that are intended to be used in what are referred to by those who are skilled in the art as "non-personnel restraint" types of applications. Likewise, the subjects matter of both of these cases draw upon features of proven technology of the type that has resulted from experience that has been gained through use of the invention that forms the subject matter of the Prior Utility Patent. Also, the subjects matter of both of these cases address an existing need to provide reliable lock assemblies that are formed from a minimal number of components that preferably include only a relatively small number of complexly configured components that are used together with components that are formed as sheet metal stampings.

The Parent Design Case to which reference is made on Page One hereof discloses appearance features, some of which are used together with some of the appearance features that are disclosed in the Prior Design Patent in the "preferred embodiment" for carrying out the "best mode" known to the inventors for practicing the present invention; however, this is done in order to enhance the appearance of the resulting product, and to incorporate certain of the appearance features that are the subject of U.S. Trademark Reg. No. 1,455,909.

SUMMARY OF THE INVENTION

The present invention addresses the need that is described above by providing a novel and improved, slam-capable door lock assembly that includes a two-part cast-type housing assembly that mounts a set of operating components for releasingly latchingly engaging projecting portions of a suitably configured keeper, with this latching engagement taking place as a closure on which the lock assembly is mounted is moved toward its "closed" position, and with the operating components including one of a pair of novel and improved stamped metal slide embodiments.

In many respects, lock assemblies that embody the "best mode" and "preferred practice" of the present invention draw from well-proven features of the type of vehicle door locks that form the subjects matter of the Prior Utility Patent and the referenced Parent Utility Case. Likewise, in many respects, lock assemblies that embody the "best mode" and "preferred practice" of the present invention draw from certain appearance features that constitute the subjects matter of the Prior Design Patent and the referenced Parent Design Case. Thus, the combination of features that comprises the claimed invention benefits not only from features of proven technology but also from much more recently developed improvement features.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

At the very outset of this description, it is appropriate to emphasize that lock assemblies of the type that embody the "best mode" and the "preferred practice" of the present invention (e.g., such lock assemblies that are designated by the numeral 100 in the description that follows, and in the accompanying drawings) are not intended for, nor are they deemed suitable for use with, what are referred to by those who are skilled in the art as "personnel restraint applications." Stated in another way, lock assemblies that embody the preferred practice of the present invention are not intended for use on vehicle doors that are utilized to confine people in passenger carrying portions of a vehicle. Rather, lock assemblies that embody the preferred practice of the present invention typically are intended for use in controlling access to non-passenger-carrying storage compartments of vehicles, and for other "non-personnel-restraint" types of applications.

Figure 1:
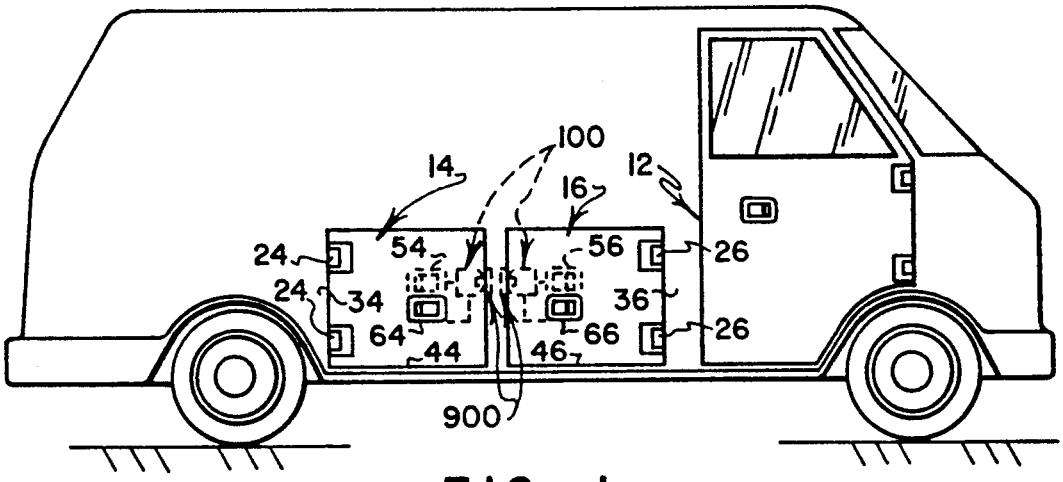
FIG. 1 is a side elevational view of a vehicle that has a pair of left and right hinged auxiliary storage compartment doors with lock assemblies that embody the preferred practice of the present invention shown in phantom to indicate locations where the lock assemblies are mounted on the doors, and with the view also showing interior and exterior handle assemblies and associated other linkage and keeper hardware.

Referring to FIG. 1, a vehicle 10 is depicted that has a passenger door 12 and a pair of auxiliary storage compartment doors 14, 16. The auxiliary storage compartment doors 14, 16 typically are of a type that are installed on specialty vehicles for purposes of permitting and preventing access to relatively small storage compartments (not shown) wherein tools, supplies and the like are carried. Lock assemblies that embody the "best mode" and "preferred practice" of the present invention are depicted in phantom in FIG. 1 as being installed on the auxiliary storage compartment doors 14, 16, and are indicated generally by the numeral 100.

In a typical application such as is depicted in FIG. 1, the auxiliary storage compartment doors 14, 16 have left and right side portions thereof that are connected by hinges 24, 26 to vehicle portions 34, 36 that surround the doors 14, 16, respectively, and that define door openings 44, 46, respectively, that are opened and closed by pivoting the hinged doors 14, 16 between "open" and "closed" positions, respectively. The lock assemblies 100 are right-mounted and left-mounted on the doors 14, 16, respectively, so as to be connected to sides of the doors 14, 16 that are opposite the door sides that are connected to the hinges 24, 26.

The door-mounted lock assemblies 100 are "slam capable," meaning that they can be "slammed" (as by closing the doors on which they are mounted) into latching engagement with suitably configured keepers that are mounted on the the vehicle portions 34, 36, such as are depicted in phantom in FIG. 1 and are designated generally by the numeral 900. The doors 14, 16 are releasably retained in their "closed" positions by virtue of latching engagements that are established when the lock assemblies 100 are moved into latching engagement with the keepers 900. The doors 14, 16 are "unlatched" and enabled to be "opened" by operating interior and/or exterior handle assemblies 54, 64 and 56, 66 that typically also are mounted on the doors 14, 16, respectively.

If interior handle assemblies 54, 56 are provided, this often is done as a safeguard to assure that, if a person inadvertently becomes confined in a storage compartment that is accessible through one of the auxiliary doors 14, 16, the associated door-carried interior handle 54 or 56 can be operated by the trapped person to open the associated door 14 or 16 and thereby escape.

Figure 2:
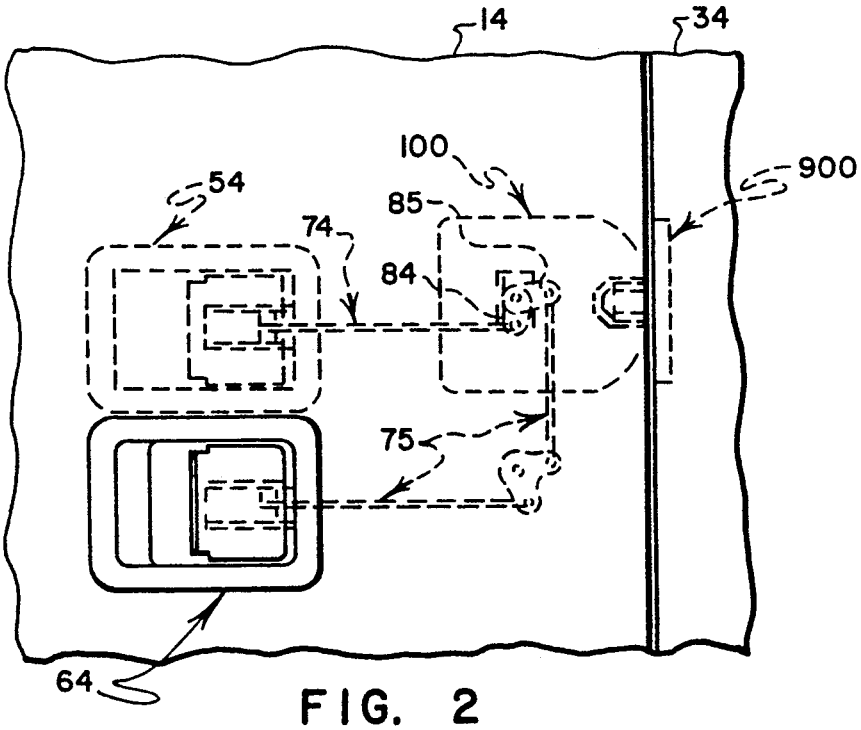
FIG. 2 is an enlarged portion of the side elevational view of FIG. 1, showing in greater detail features of one of the lock assemblies and its associated interior and exterior handle assembly and associated other linkage and keeper hardware.

Because the manners in which the two lock assemblies 100 that are shown in FIG. 1 function are identical (with the exception that the mounting of each of the lock assemblies 100 and its associated hardware presents a mirror image of the mounting of the other of the lock assemblies 100 and its associated hardware), only relevant features of one of the lock assemblies 100 and its associated hardware will be described. Referring to FIG. 2, enlarged portions of the left-hinged door 14 and its adjacent door frame 34 are shown; the associated door-carried lock assembly 100 and the associated door-frame-carried keeper 900 are shown in phantom; the associated outside handle assembly 64 is depicted in solid lines; the associated inside handle assembly 54 is depicted in phantom; and linkages 74, 75 are depicted in phantom that serve to operably connect the inside and outside handle assemblies 54, 64 to the lock assembly 100. The outside handle assembly 64 is depicted as including a conventional key-cylinder 50 that can be used to selectively enable and disable the outside handle assembly 64 from operating its associated linkage 75. The handle-assembly-operated linkages 74, 75 include bell cranks 84, 85 that are positioned on opposite sides of the housing of the lock assembly 100 for connecting the linkages 74, 75 to separate "operator members" that form components of the lock assembly 100 (as will be described later herein). By this arrangement, either one of the handle-operated linkages 74, 75 may be actuated by operating its associated handle 54, 64 to operate the lock assembly 100 to effect "unlatching" of the lock assembly from latching engagement with the keeper 900 (as also will be described later herein).

As those who are skilled in the art readily will understand, a wide variety of commercially available door handle assemblies and associated linkage elements may be employed to operate the lock assemblies 100. By way of one example, reference is made to the handle assemblies and associated linkage elements that are disclosed in the aforementioned Prior Utility Patent, with particular reference being made to FIGS. 1–3 thereof and the description that is associated therewith. Because the character of operating handles and associated linkages that are used in conjunction with the lock assemblies 100 forms no part of the present invention; because features of a typical arrangement of such handles and their associated linkages are described and illustrated in the Prior Utility Patent, the disclosure of which is incorporated herein by reference; and because the character and commercial availability of such components is well known to those who are skilled in the art, further discussion of features of such handles and linkages as are depicted in FIGS. 1 and 2 need not be presented here.

Figure 3:
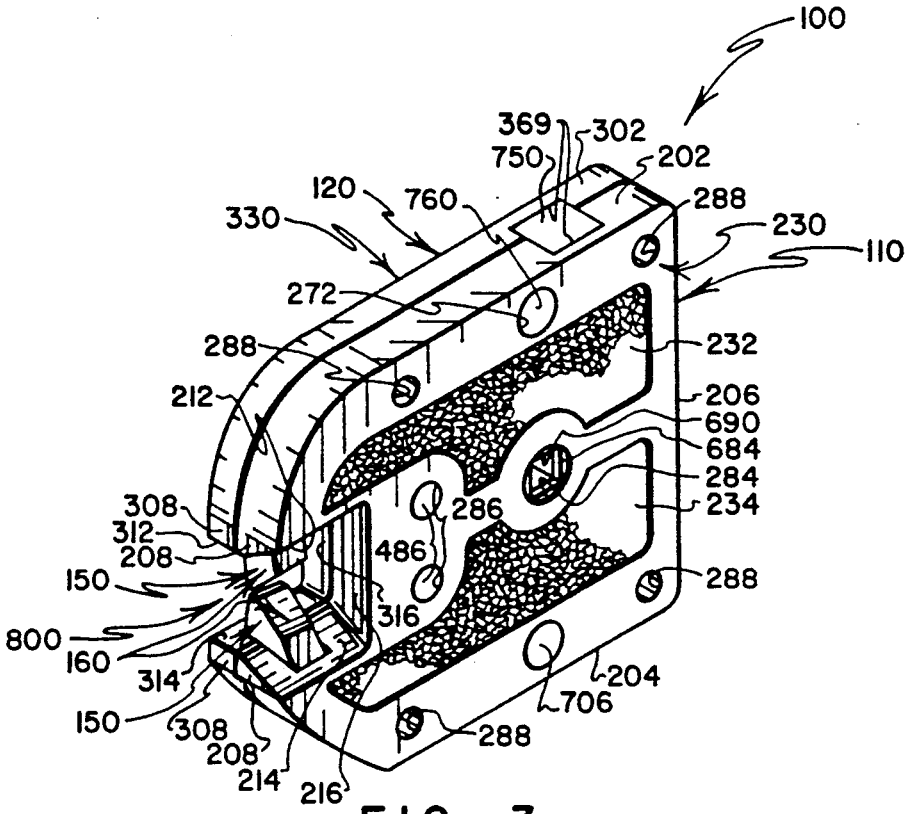
FIG. 3 is a perspective view, on an enlarged scale, showing a lock assembly that embodies the "best mode" and the "preferred practice" of the present invention, with the view showing principally exterior surface features of a first of two housing members that protectively enclose and movably mount operating components of the lock assembly, and with the view showing a pair of opposed latch members extending into opposite side regions of a keeper-receiving passage that is defined by the housing members.
Figure 4:
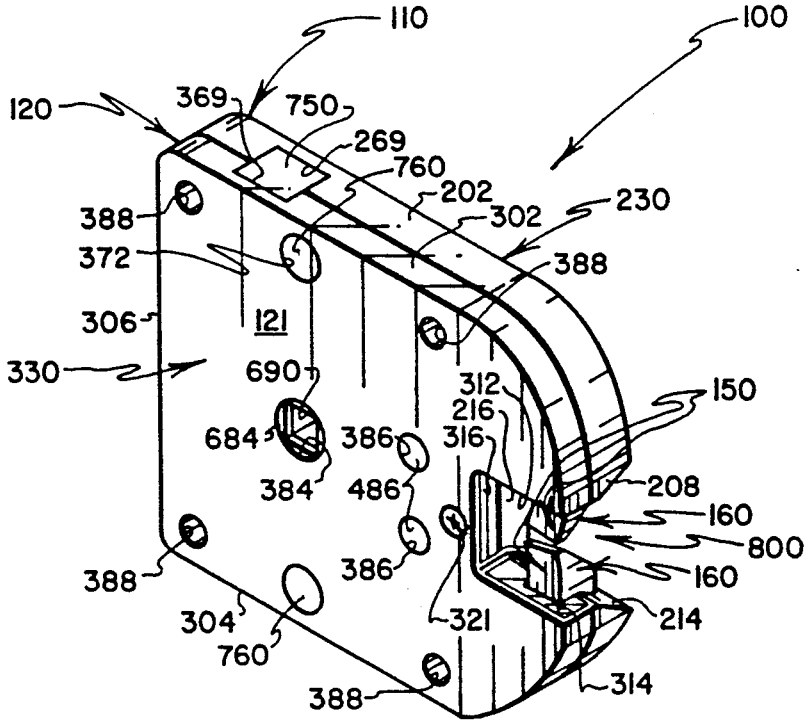
FIG. 4 is a perspective view similar to FIG. 3 but showing principally exterior surface features of a second of the two housing members.
Figure 5:
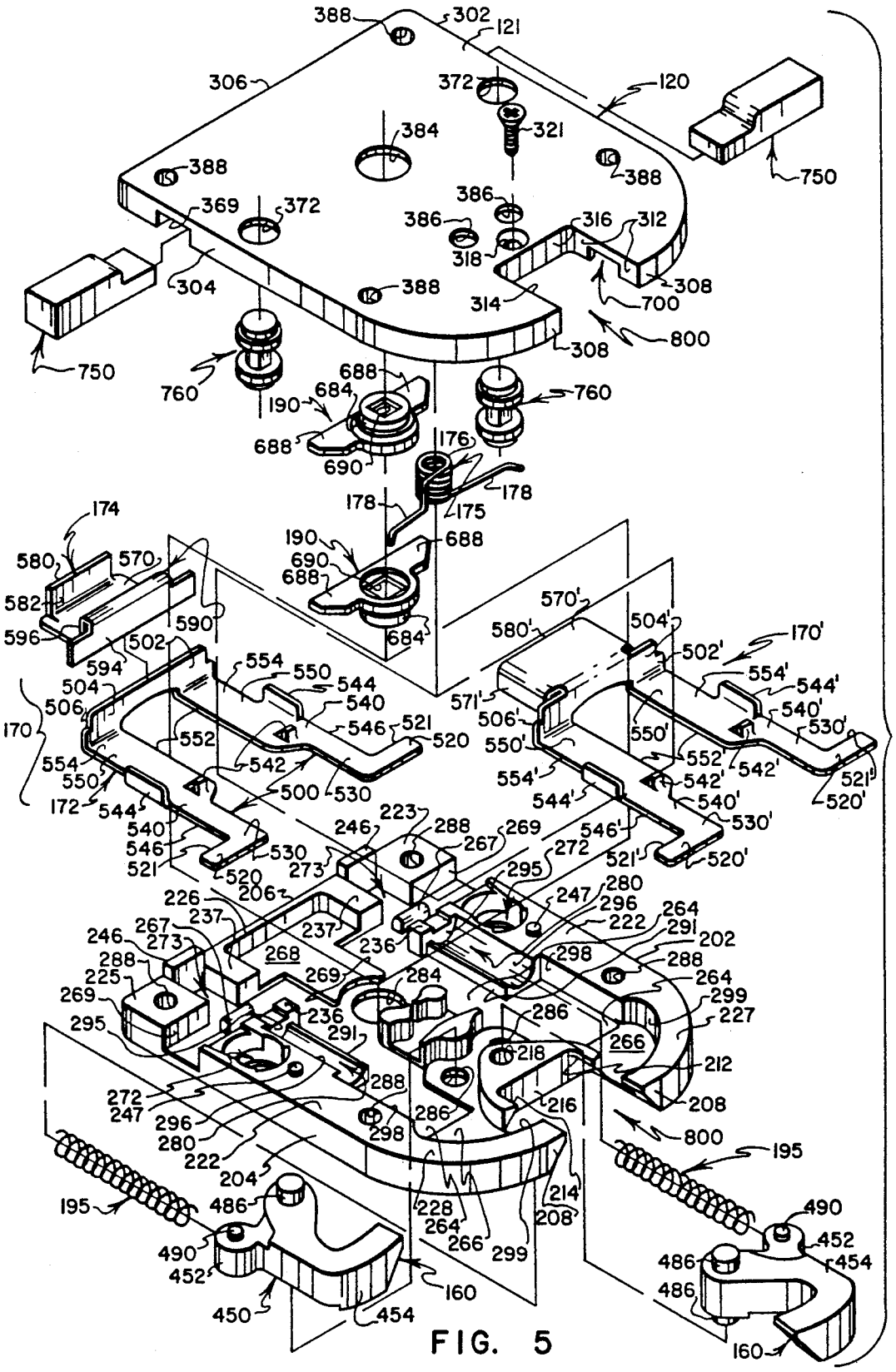
FIG. 5 is an exploded perspective view showing components of the lock assembly, with the view showing alternate one and two piece embodiments of stamped slide components that may be substituted interchangeably for use with the other depicted components.

Turning now to an overview of the lock assembly 100, and referring to FIGS. 3–5, a housing assembly is provided by a first housing member 110 and a second housing member 120 that are configured to extend in congruent overlying engagement. Referring to FIG. 5, the first and second housing members 110, 120 cooperate to define a central chamber 130 that receives, operably positions and movably mounts a number of operating components that are indicated generally by the numeral 140. Defined near a curved end region of the housing assembly is a generally U-shaped keeper-receiving passage that is indicated generally by the numeral 800. Included among the operating components 140 are a pair of oppositely pivoted latch members 150. The latch members 150 have tapered, distal end regions 160 that extend through latch member passages 700 that open into the keeper-receiving passage 800 on opposite sides thereof. The tapered distal end regions 160 of the latch members 160 move in opposite directions so as to be capable of retracting into the latch member passages 700 to release their engagement with a suitably configured keeper 900 (shown in phantom in FIGS. 1 and 2, and more clearly in FIGS. 12 and 13), or to project into opposite sides of the keeper-receiving passage 800 so as to selectively grip portions of a suitably configured keeper. Moreover, and as will be explained later herein in greater detail, the latch members 150 can be "slammed" into latching engagement with a suitably configured keeper 900 as by moving a door (such as one of the doors 14, 16) on which the lock assembly 100 is mounted to its "closed" position.

Figure 6:
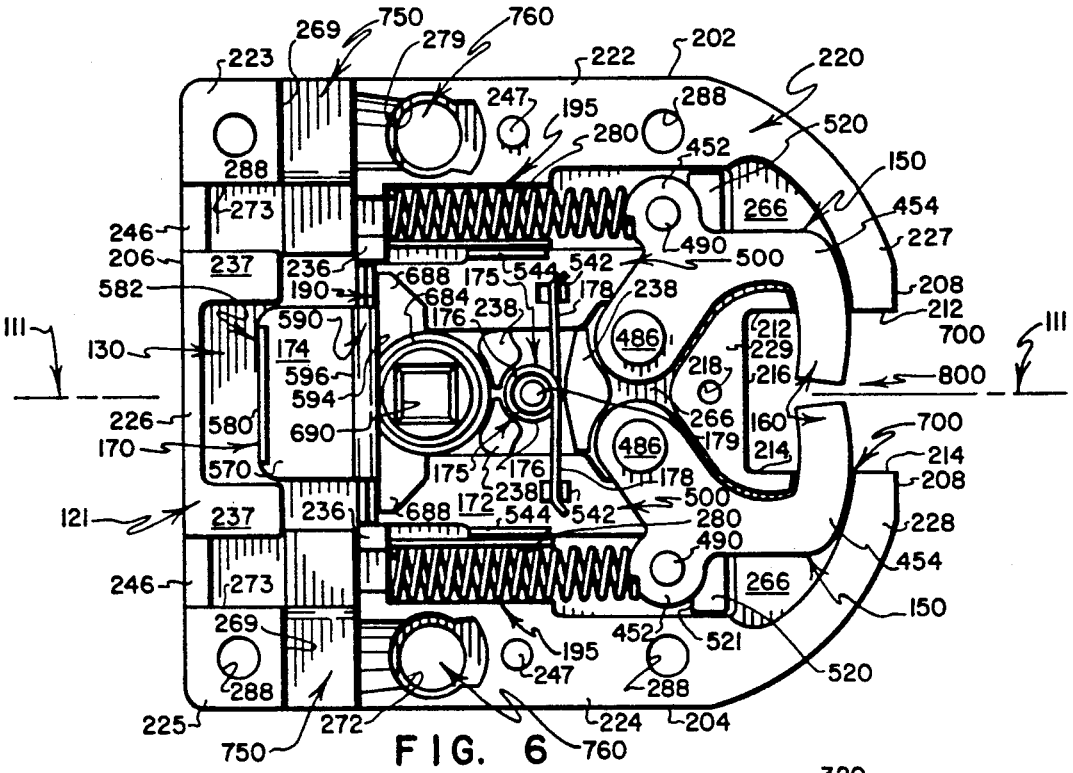
FIG. 6 is a side elevational view of interior features of a first of the two housing members, with the view also showing others of the lock assembly components installed within a central chamber that is defined by the first housing member, with the installed components including the two-piece slide embodiment (components of which are depicted in FIG. 5), and with the installed components being positioned as they normally are when the lock assembly is ready to be "slammed" into latching engagement with a suitably configured keeper.
Figure 14:
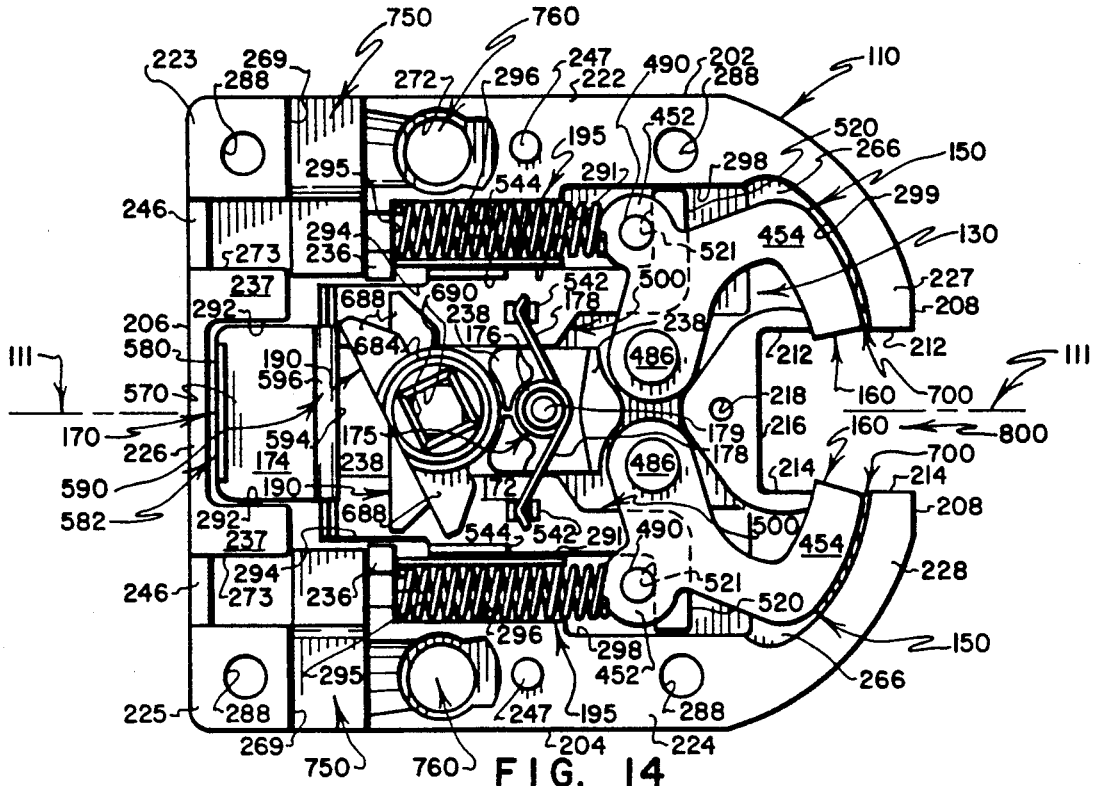
FIG. 14 is a side elevational view similar to FIG. 6 but showing selected operating components moved to effect "unlatching" of the latch members of the subject lock assembly; and, FIG. 15 is a side elevational view similar to FIGS. 6 and 14 but with all operating components removed from the central chamber of the first housing member so that underlying interior features thereof can be seen.

Referring to FIGS. 5 and 6, also included among the operating components 140 is a selected one of two types of slide embodiments 170, 170', a dual-acting torsion coil spring 175 for biasing the selected one of the slides 170, 170' toward its "latching" position (shown in FIG. 6), a pair of pivotally movable slide operators 190 (only one of which is viewable in FIG. 6, but portions of both of which are viewable in FIGS. 5 and 14) that are independently pivotal such that either one can effect movement of the selected slide 170, 170' toward its "unlatching" position (as is depicted in FIG. 14), and a pair of compression coil springs 195 that bias the latch members 150 toward their "latched" positions (shown in FIGS. 3, 4 and 6).

Turning now to a more detailed description of features of the lock assembly 100, the first and second housing members 110, 120 each are relatively flat and are bounded by correspondingly configured side and end surfaces so as to permit their being positioned in overlying relationship such that their corresponding side and end surfaces extend substantially congruently. Both of the housing members 110, 120 preferably are formed using conventional die casting techniques of manufacture to provide rigid metal components that each define approximately half of the overall thickness of the housing of the lock assembly 100. Each of the housing members 110, 120 has inner, centrally located portions that are "hollowed out" or "relieved" and configured to contribute significantly to the mounting and positioning of the aforementioned operating components 140—and that cooperate to protectively enclose, position and mount the operating components 140.

Figure 7:
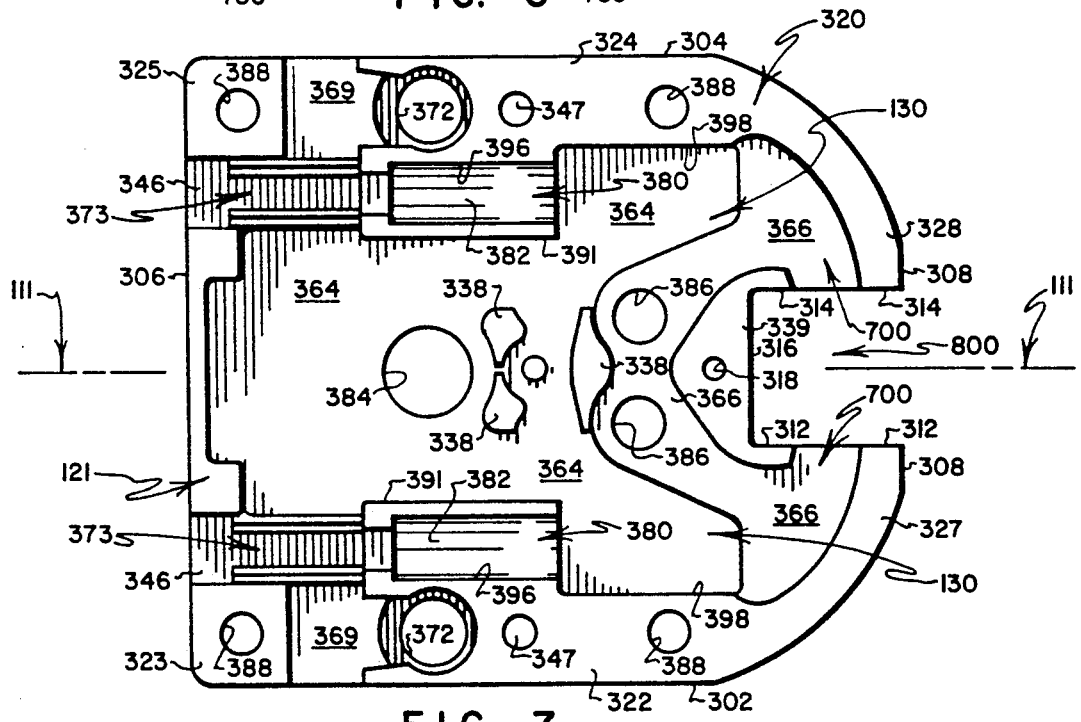
FIG. 7 is a side elevational view of interior surface features of the second of the two housing members.
Figure 8:
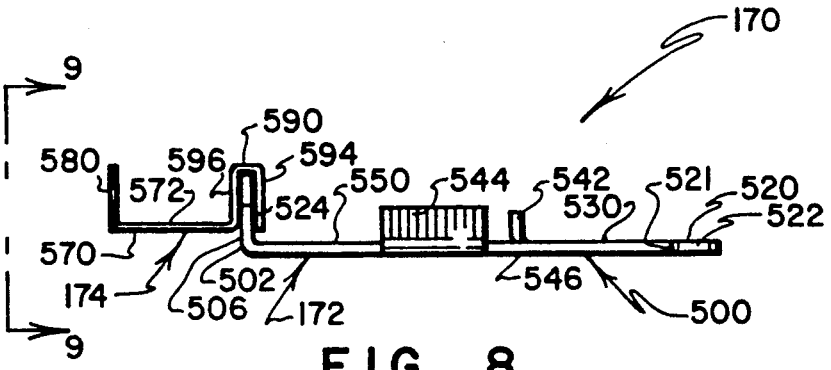
FIG. 8 is a side elevational view of an assembled two-piece stamped slide embodiment formed from components that are depicted in the exploded view of FIG. 5.
Figure 9:
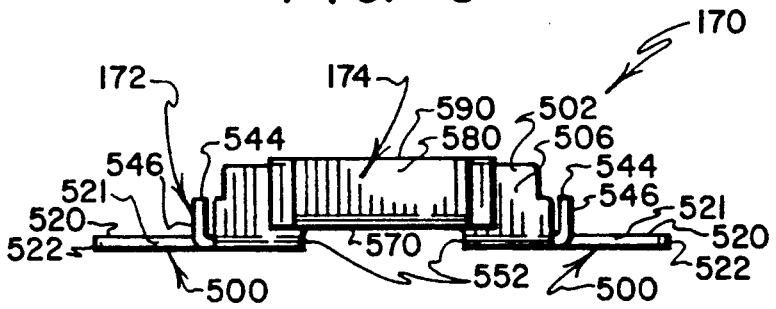
FIG. 9 is a left end elevational view thereof as seen from a plane indicated by line 9—9 in FIG. 8.

Referring variously to FIGS. 3–7, the first and second housing members 110, 120 have opposed side surfaces that are designated generally by the numerals 202, 204 and 302, 304, respectively; have opposed end surfaces that are designated generally by the numerals 206, 208 and 306, 308, respectively; and have passage-defining surfaces 212, 214, 216 and 312, 314, 316 that define the generally U-shaped keeper-receiving passage 800 that opens through the end surfaces 208, 308, respectively. Referring to FIGS. 5–7, the housing members 110, 120 have interior surfaces 220, 320, respectively, that face toward each other. Referring to FIGS. 3–5, the housing members 110, 120 have exterior surfaces 230, 330, respectively, that face away from each other—and that define opposed exterior surfaces of the lock assembly 100. The side surfaces 202, 204, together with the end surfaces 206, 208 and the passage-defining surfaces 212, 214, 216 define the periphery of the first housing member 110 and define the peripheries of the interior and exterior surfaces 220, 230. The side surfaces 302, 304, together with the end surfaces 306, 308 and the passage-defining surfaces 312, 314, 316 define the periphery of the second housing member 120 and define the peripheries of the interior and exterior surfaces 320, 330.

Referring to FIG. 3, the exterior surface 230 of the first housing member 110 is substantially flat—except that, in preferred practice, a pair of surface areas 232, 234 are provided with a textured finish to enhance the appearance of the first housing member 230 and to give major exterior portions of the lock assembly 100 substantially the same appearance that forms the subject of U.S. Trademark Reg. No. 1,455,909. In view of the substantially flat nature of the exterior face 230, it can be said that the face 230 is comprised of surface elements that extend substantially in a first imaginary plane (not shown).

Referring to FIGS. 5, 6, 14 and 15, the interior surface 220 of the first housing member 110 is comprised of peripherally extending surface portions 222, 223, 224, 225, 226, 227, 228, 229; inwardly extending surface portions 236, 237; and centrally located surface portions 238. The surface portions 222–229 and 236–238 comprise the interior surface 220 and all extend substantially in a common second imaginary plane (not shown). The exterior and interior surfaces 230, 220 are oriented such that the aforementioned first and second imaginary planes extend substantially parallel, with the distance therebetween defining what will be referred to as a "major thickness" of the first housing member 110.

Referring to FIG. 7, in like fashion the interior surface 320 of the second housing member 120 is comprised of peripherally extending surface portions 322, 323, 324, 325, 326, 327, 328, 329; inwardly extending surface portions 336, 337; and centrally located surface portions 338. The surface portions 322–329 and 336–338 comprise the interior surface 320 and all extend substantially in a common imaginary plane (not shown). The exterior and interior surfaces 330, 320 extend substantially parallel, with the distance therebetween defining what will be referred to as a "major thickness" of the second housing member 120.

While significant portions of the first housing member 110 have a thickness that corresponds to the aforementioned "major thickness," four portions of the first housing member 110 are formed (during casting of the first housing member 110) so as to be of greater thickness, namely a pair of generally rectangular post-like projections 246 that are located along spaced portions of the end surface 206, and a pair of generally cylindrical post-like projections 247 that are formed on the housing portions 222, 224. During the process of assembling the components of the lock assembly 100, the rectangular projections 246 of the first housing member 110 are inserted into correspondingly configured notches 346 that are formed at spaced locations along the end surface 306 of the second housing member 120; and the cylindrical post-like projections 247 are inserted into locator depressions 347 (see FIG. 7) that are formed in the housing portions 322, 324 of the second housing member 120. A threaded fastener 321 (see FIGS. 4 and 5) is inserted through a hole 318 (see FIG. 7) that is formed through the second housing member 120, and is threaded into an aligned hole 218 (see FIG. 6) that is formed in the first housing member 110. Other types of fasteners and/or fastening methods can, of course, be used to securely connect the first and second housing members 110, 120 when the process of assembling the lock assembly 100 is complete.

Figure 15:
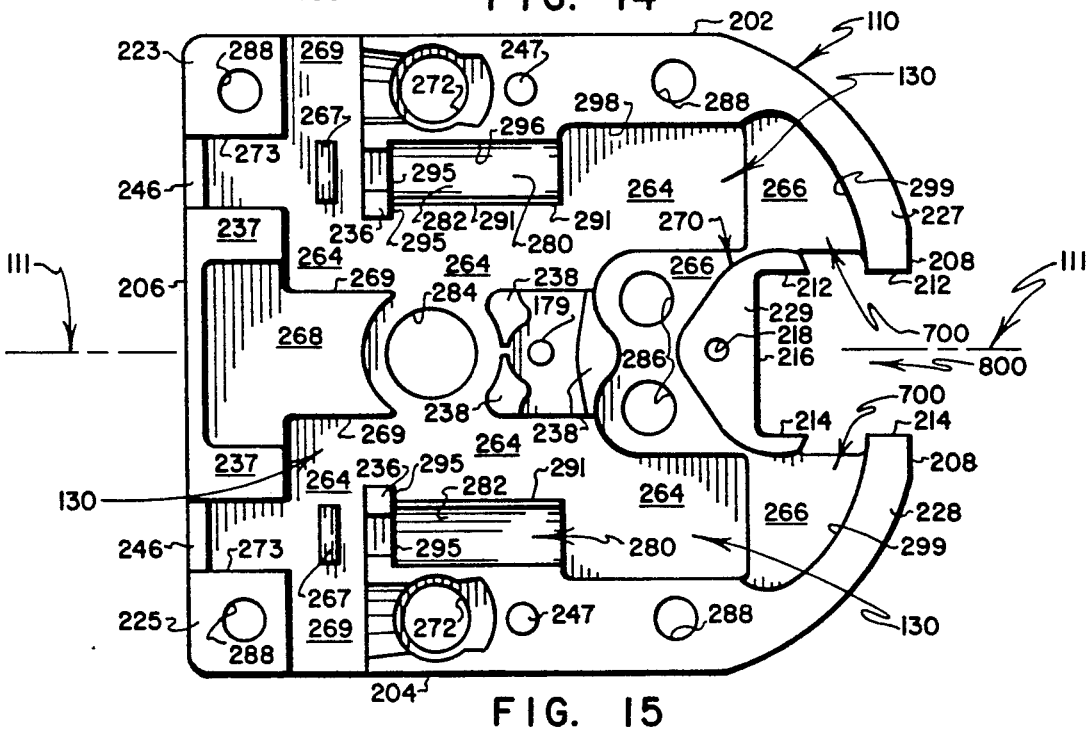

While the thickness of the first housing member 110 exceeds the aforedescribed "major thickness" only at the aforedescribed locations of the post-like projections 246, there are a number of locations wherein the first housing member 110 has thicknesses that are significantly less than the major thickness. Referring principally to FIGS. 5 and 15, the major thickness of the first housing member is "relieved" such that the central chamber 130 has a plurality of "floor levels," defined at various locations, as will now be described.

Referring to FIG. 15, a "primary" floor level is defined by something of an H-shaped central floor portion 264—and, the central portion 264 cooperates with the exterior surface 230 to give the first housing member 110 its minimum thickness. A "secondary" floor level is defined by floor portions 266 that are located within the general vicinity of an upstanding U-shaped formation 270 that defines portions of the passage walls 212, 214, 216. The floor portions 266 cooperate with the exterior surface 230 to define a floor thickness that is slightly greater than the minimum thickness that is provided by the central floor portion 264.

A "tertiary" floor level is defined by a floor portion 268 that extends into the central chamber 130 from the end wall 206 so as to provide a region of still greater floor thickness. Opposite sides of the tertiary floor portion 268 are bounded by parallel side walls 269 that extend substantially perpendicular to the plane of the end wall 206 of the first housing member 110.

In much the same manner that interior portions of the first housing member 110 are "relieved" so as to provide the aforedescribed features, the second housing member 120 has its interior "relieved" to provide a number of similar features. Referring to FIG. 7, a "primary" floor level is defined by something of a central floor portion 364 that overlies much of the central floor portion 264; and, a "secondary" floor level is defined by floor portions 366 that overlie much of the same general area as is occupied by the aforedescribed floor portions 266. The central floor portion 364 cooperates with the exterior surface 330 to give the second housing member 110 its minimum thickness; and, the "secondary" level floor portions 366 cooperate with the the exterior surface 330 to give the second housing member 120 regions of slightly greater thickness.

Referring principally to FIGS. 5 and 15, interior formations of the first housing member 110 include a pair of curved-bottom channels 280 extend along the housing portions 222, 224; have bottom portions 282 that cooperate with the exterior surface 230 to provide a thickness that is slightly greater than the thickness that is provided by the tertiary floor portions 268; and are bordered along their inner sides by upstanding wall portions 291 that extend parallel to each other at locations on opposite sides of the central floor portion 264 for purposes of engaging and assisting in guiding sliding movements of whichever one of the slide embodiments 170, 170' that is selected to be used within the central chamber 130.

Referring to FIG. 7, the second housing member 120 is provided with similar curved-bottom channels 380 that extend along the housing portions 322, 324; that have bottom portions 382; and that are bordered by opposed, inwardly-facing, parallel wall portions 391.

Referring to FIGS. 6 and 14 wherein the first housing component 110 is shown with operating components 140 of the lock assembly 110 installed therein, together with FIGS. 5, 7 and 15 wherein portions of the interiors of the housing members 110, 120 are shown without any of the components 140 being installed therein, the first and second housing members 110, 120 are provided with some interior formations that are not utilized by the lock assembly 100. The unused features to which reference is here being made will be described shortly; however, a generalization that can be made regarding these features is that they are arranged in pairs so as to be positioned symmetrically about the center plane 111; and, they are located in out-of-the-way positions so as to not interfere with the functioning of the operating components 140 of the lock assembly 100. The purpose of providing these "unused features" is to enable the housing members 110, 120 to be used to provide other forms of lock assemblies, for example lock assemblies of the general type that are disclosed in the referenced Prior Utility and Design Patents, the disclosures of which are incorporated herein by reference.

Inasmuch as the so-called "unused features" are not made use of or in any way employed in the functioning of the operating components 140 of the invention 100, such features will be only briefly described for, as those who are skilled in the art readily will appreciate, these features can be entirely eliminated from the housing members 110, 120 without in any way adversely affecting the operational character of the resulting lock assembly 100.

Opposed, overlying, sidewardly opening passage portions 269, 369 are defined by the first and second housing members 110, 120—but are not utilized for functional purpose in the lock assembly 100. Referring to FIG. 6, a pair of projections 267 extend upwardly from such portions of the surface 264 as extend into the passage portions 269. For purposes of closing the sidewardly opening passage portions 269, 369, plastic plug members 750 optionally may be provided. The plug members 750 are suitably configured to receive the projections 267 so as to be retained within the passage portions 269, 369.

Aligned pairs of holes 272, 372 are formed in the peripheral portions 222, 322 and 224, 324 of the first and second housing members 110, 120—but are not utilized for functional purpose in the lock assembly 100. For purposes of closing the holes 272, 372, plastic plug members 760 optionally may be provided. The plug members 760 are suitably configured to be inserted into relatively complexly configured interior portions of the holes 272, 372 so as to be self-retained therein once the various components of the lock assembly 100 have been duly assembled.

A pair of notch-like formations 273 are provided on the interior of the first housing member 100 in overlying relationship with a pair of trough-like formations 373 that are provided on the interior of the second housing member 110—but neither of the formations 273, 373 are utilized for functional purpose in the lock assembly 100.

Many of the aforementioned and other features of the first and second housing members 110, 120 are configured so as to give the first and second housing members 110 shapes that are substantially symmetrical about a common imaginary central plane 111, the position of which is indicated by center line segments that appear in FIGS. 6, 7, 14 and 15. While a number of these symmetrical features are mentioned in the paragraphs that follow, there are many additional features of components of the lock assembly 100 that are not emphasized in the text hereof but which nonetheless are arranged symmetrically about the center plane 111, as will be readily apparent to those who are skilled in the art from reviewing what is depicted in the accompanying drawings.

A plurality of holes are formed through the first and second housing members 110, 120 all of which extend along spaced parallel axes (not shown). Aligned, relatively large diameter holes 284, 384 open through the primary floor portions 264, 364 into a central part of the central chamber 130, with the common axis (not shown) of the holes 284, 384 being oriented to extend within the central plane 111. Cylindrical hub portions 684 of the lock operator members 190 extend into and are journaled by the holes 284, 384 for purposes of pivotally mounting the lock operator members 190 for smooth, independent rotation about the common axis of the holes 284, 384.

Two pairs of aligned, medium sized holes 286, 386 open through the secondary floor portions 266, 366 with the common axes (not shown) of the two aligned pairs of the holes 286, 386 being located on opposite sides of the central plane 111 and at substantially equal distances therefrom. Pairs of opposed, aligned, generally cylindrical formations 486 are provided on the latch members 150 for pivotally connecting the latch members 150 to the housing members 110, 120 as by extending into the aligned pairs of holes 286, 386. The holes 286, 386 journal the formations 486 so as to mount the latch members 150 for smooth rotation about the axes of the aligned pairs of holes 286, 386.

Relatively small diameter mounting holes 288 open through the major thickness peripheral portions 222, 223, 224, 225 of the first housing member 110. Likewise, small holes 388, open through the major thickness peripheral portions 322, 323, 324, 325 of the second housing member 120, with each of the holes 388 being aligned with a separate corresponding one of the holes 288. Elongate, threaded fasteners (not shown) extend through aligned pairs of the holes 288, 388 for purposes of securely mounting the lock assemblies 100 on closures such as the aforedescribed auxiliary doors 14, 16.

Referring to FIGS. 5–7, 14 and 15, inwardly facing pairs of wall portions 291, 292, 294, 296, 298 and 391, 392, 394, 396, 398 are defined by the housing members 110, 120, respectively. The wall portions that comprise each of these pairs are arranged symmetrically about the center plane 111 and extend along opposite side portions of the central chamber 130. Selected ones of these wall portions are engaged by opposed edge portions of whichever one of the slide embodiments 170, 170' that is selected for use within the central chamber 130 of the lock assembly 100.

Curved, inwardly-facing wall surfaces 299, 399 are provided on the housing members 110, 120, respectively, for joining with the wall portions 298, 398 to protectively enclose regions wherein hook-shaped portions of the latch members 150 pivotally move in opposed directions during latching and unlatching movements of the tapered distal end regions 160 of the latch members 150. The curved surfaces 299, 399 define portions of the latch member passages 700 that open into the keeper-receiving passage 800.

Referring to FIGS. 5, 6 and 14, the latch members 150 have configurations that are left and right mirror images of each other, with the configurations of each of the latch members 150 bearing a general resemblance to the configuration of the numeral "2." Cylindrical projections 486 extend from opposite sides of one end region 448 of an elongate base portion 450 of each of the latch members 150. The cylindrical projections 486 extend into and are journaled by the holes 286, 386 to mount the latch members 150 for smooth pivotal movement relative to the housing members 110, 120. Opposite end regions 452 of the base portions 450 have additional cylindrical projections 490 extending from opposite sides thereof. The additional projections 490 slide along interior surface portions of the housing members 110, 120, and do not in any way limit or inhibit latching or unlatching pivotal movements of the latch members 150 about the axes of the projections 486.

Two significant functions are provided by such ones of the cylindrical projections 490 as extend toward the primary floor surface 464 of the first housing member.

As is best seen in FIG. 5, oppositely projecting foot portions 520, 520' are provided on the slide embodiments 170, 170', and leftwardly-facing edge surfaces 521, 521' are defined by the foot portions 520, 520'. Depending on which one of the slide embodiments 170, 170' that is selected for incorporation into the lock assembly 100, either the edge surfaces 521 or the edge surfaces 521' are positioned to abuttingly engage such ones of the cylindrical projections 490 as extend toward the primary floor surface 464. Referring to the phantom-line depictions of the edge surfaces 521 that are shown in FIG. 14, it will be seen that, when the slide embodiment 170 is moved leftwardly within the central chamber 130 (which occurs as the result of pivotal operation of one of the operators 190, as will be explained later herein), the edge surfaces 521 abuttingly engage adjacent ones of the cylindrical projections 490 and cause corresponding pivotal unlatching movements of the latch members 150. Thus, one function that is served by such ones of the cylindrical projections 490 as extend toward the primary floor surface 264 is to provide an abutting-type of driving connection between the latch members 150 and whichever one of the slide embodiments 170, 170' that may be selected for use in the lock assembly 100.

Figure 12:
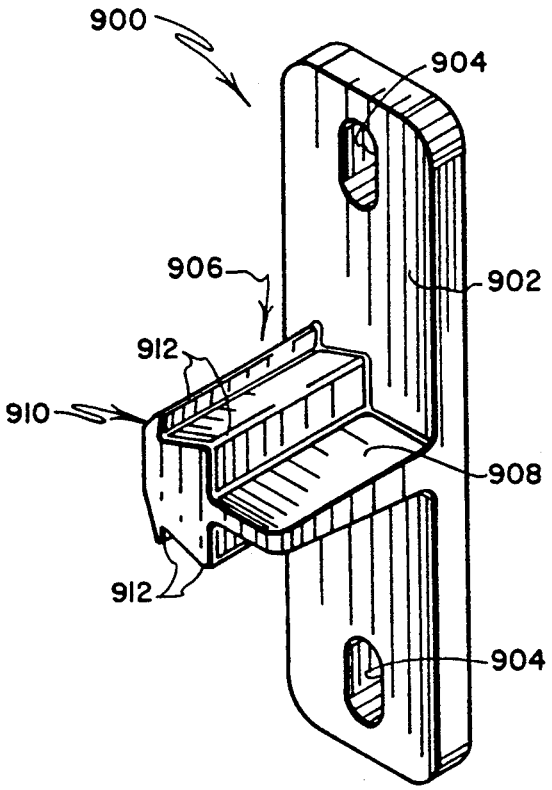
FIG. 12 is a perspective view of a suitably configured keeper for use with the subject lock assembly.
Figure 13:
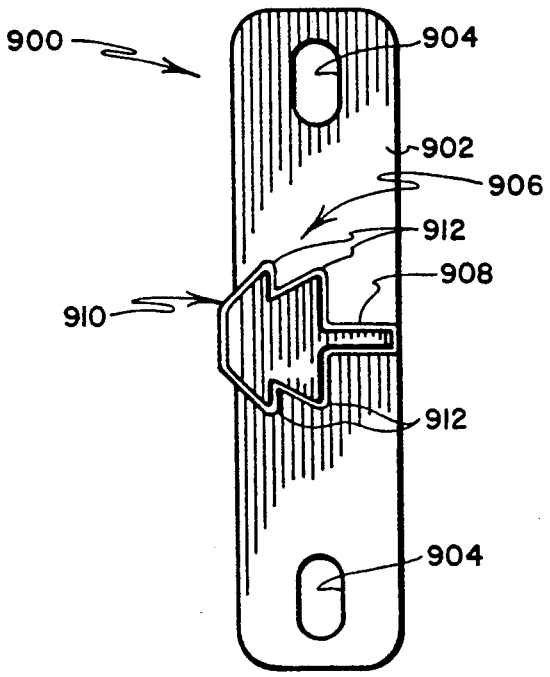
FIG. 13 is a side elevational view thereof.

A second function that is provided by the abutting type driving connection that is established between the latch members 150 and a selected one of the slide embodiments 170, 170' is that, while the operation of the compression coil springs 195 tends to bias the latch members 150 toward a position wherein the described ones of the cylindrical projections 490 engage the slide edge surfaces 521, 521', the latch members 150 nonetheless remain free to move independently relative to the selected slide embodiment 170, 170'. Stated in another way, the aforedescribed driving engagement between selected ones of the projections 490 and the slide edge surfaces 521, 521' is not necessarily maintained at all times—whereby the lock assembly 100 is given its "slam capability" (i.e., its ability to be "slammed" toward a suitably configured keeper 900 so that, as portions of the keeper 900 are engaged by the tapered distal end regions 160 of the latch members 150, the latch members 150 may pivot in opposition to the actions of their biasing springs 195 (and without causing any corresponding movement of or application of force to the selected slide embodiment 170, 170') to ride over frontal portions of a suitably configured keeper 900 so as to drop into latched position behind such frontal portions (as will be explained in greater detail later herein in conjunction with a discussion of the preferred form of keeper 900 that is depicted in FIGS. 12 and 13).

Returning now to a discussion of the configuration of the latch members 150, and referring to FIGS. 5, 6 and 14, curved, hook-shaped portions 454 project away from the base portions 450 of the latch members 150. The tapered, distal end regions 160 of the latch members 150 are defined by the hook-shaped portions 454, and extensible through the opposed latch member passages 700 into opposite sides of the U-shaped keeper-receiving passage 800.

The compression coil springs 195 have central portions thereof that extend along the curved-bottom channels 280 of the first housing member 110. One end of each of the springs 195 engages a separate one of the housing wall surfaces 295. The other end of each of the springs 195 engages the base portion 452 of a separate one of the latch members 150.

Referring to FIG. 5, the two-piece slide embodiment 170 consists of two snap-together sheet metal members 172, 174 that, when assembled, have the appearance that is shown in FIGS. 6, 8, 9 and 14. The larger of the two members, namely the member 172, is formed from sheet metal and has a pair of elongate, substantially parallel extending portions that are indicated generally by the numeral 500, and which are joined near one end region by a bridging leg formation 502.

In similar fashion, the one-piece slide embodiment 170' consists of a single member 172' that is formed from sheet metal. The member 172' has a pair of elongate, substantially parallel extending portions that are indicated generally by the numeral 500'. The parallel portions 500' are joined near one end region by a bridging leg formation 502'.

Figure 10:
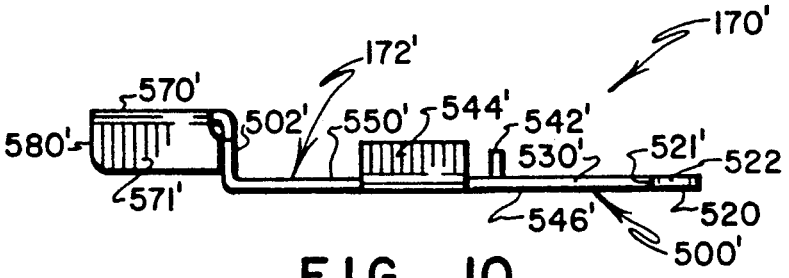
FIG. 10 is a side elevational view that is similar to FIG. 8 but that depicts the one-piece stamped slide embodiment that also is shown in FIG. 5, and that can be used interchangeably with the two-piece stamped slide embodiment of FIGS. 8 and 9.
Figure 11:
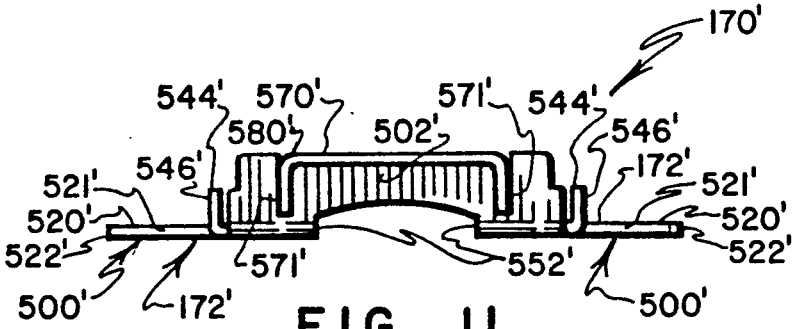
FIG. 11 is a left end elevational view thereof.

The parallel extending portions 500, 500' of the portions 172, 172' are identical one with another. Moreover, each of the two members 500 or 500' that are connected by an associated one of the bridging formations 502 or 502' are configured so as to present left and right mirror images of each other. Thus, while features of the portions 500' are depicted in FIGS. 10 and 11, it will be understood that, since the portions 500, 500' are completely identical in form, features of the portions 500 that are shown in FIGS. 6, 8, 9 and 14 are duplicated in the configurations of the portions 500'.

Referring principally to FIG. 5 (but also from time to time to FIGS. 6, 8, 9 and 14), the portions 500 define a number of formations that are arranged symmetrically about the center plane 111, including: transversely extending foot portions 520 that have distal outer end surfaces 522 that are configured to slide along the interior housing surfaces 298 during movement of the slide member 170 between its latching position (shown in FIG. 6) and its unlatching position (shown in FIG. 14); lower leg portions 530 that are of relatively uniform width until they reach what will be referred to as "knee" regions 540 where a pair of relatively small tab portions 542 and a pair of relatively large tab portions 544 are turned upwardly from a plane (not shown) within which the majority of the material extends that forms the portions 500, with the lower leg portions 530 and the upwardly-turned tab portions 544 cooperating to define outer surfaces 546 that are configured to slide along the interior housing surfaces 291 during latching and unlatching movements of the slide member 170; and, upper leg portions 550 that are relatively wider than the lower leg portions 530 and have inner and outer surfaces 552, 554 that are configured to engage the interior housing surfaces 269, 294, respectively, during latching and unlatching movements of the slide member 170.

The bridging leg formation 502 comprises an upwardly turned, integrally formed extension of the upper leg portions 550, and is configured to bridge the tertiary floor portion 568 during latching and unlatching movements of the slide member 500. The bridging leg formation 502 has opposed side surfaces 504, 506.

The member 172' that forms the one-piece slide embodiment 170' has features that correspond to those of the member 172 that have just been described. Identical reference numerals are used in the drawings to designate identical features of the slide components 172, 172' except that the numerals used with the slide component 172' carry a "prime" mark.

Referring principally to FIG. 5 (but with occasional reference also to FIGS. 6, 8, 9 and 14), the smaller component 174 of the two-piece slide embodiment 170 has a generally flat central portion 570 that extends from the vicinity of the bridging leg 502 toward the end wall 206 of the first housing member 110, with opposed side surfaces thereof being indicated by the numerals 572. The opposed surfaces 572 are configured to slide along the interior housing surfaces 292 during latching and unlatching movements of the two-piece slide embodiment 170. In similar fashion, the one-piece slide embodiment 170' has a generally flat central portion 570' that extends toward the housing end wall 206 and has downwardly-turned flanges 571' that define opposed side surfaces 572' that are configured to slide along the interior housing surfaces 292 during latching and unlatching movements of the one-piece slide embodiment 170'. While the central portion 570' of the one-piece slide embodiment 170' is formed as an integral extension of the associated bridging leg 502', in the two-piece slide embodiment 170 the central portion 570 is defined by the separate, smaller component 172.

The smaller component 172 of the two-piece slide embodiment 170 has still another feature in common with the integrally formed one-piece slide embodiment 170, namely end surfaces 580, 580' that are provided along the left ends of the central portions 570, 570'. The end surfaces 580, 580' are configured to abut the end walls 206 of the first housing member 110 and to thereby serve as "stops" to limit the "unlatching" movement that is executed by the slide embodiments 170, 170' in response to operation of one or the other of the operator members 190 (the operation of which will be described shortly). In the two-piece embodiment 170, an upwardly-turned flange 582 assists in defining the end surface 580. In the one-piece embodiment 170' the downwardly turned flanges 571' assist in defining the end surface 580'.

The smaller component 172 of the two-piece slide embodiment 170 has a U-shaped clip-like mounting portion 590 that has no corresponding formation in the structure of the one-piece slide embodiment 170'. The U-shaped clip 590 has spaced, overlying surfaces 594, 596 that are configured to extend along and to grip the opposed surfaces 504, 506, respectively, of the bridging leg portion 502 so as to couple the smaller component 172 to the larger component 170 in what can be referred to as "snap-together" fashion.

Referring to FIGS. 5, 6 and 14, the torsion coil spring 175 has a central coil winding 176 formed from spring wire, with opposed end regions 178 of the spring wire extending in generally opposite directions. The central coil winding 176 is installed about an upstanding post formation 179 that forms a part of the first housing member 110. The end regions 178 extend into engagement with the small, upwardly turned tabs 542 or 542' of such one of the slide embodiments 170, 170' as has been selected for use in the lock assembly 100—and serves to bias the selected slide embodiment 170, 170' toward its latching position (shown in FIG. 6). When the selected slide embodiment 170, 170' moves to its unlatching position (shown in FIG. 14), this movement is carried out in opposition to the biasing action of the spring 175 and causes the end regions 178 of the spring 175 to be deflected leftwardly (as will be noted by comparing the configuration of the spring 175 as it is shown in FIGS. 6 and 14).

The operator members 190 are identical one with another, but are positioned in back-to-back relationship with their hub portions 684 extending in opposite directions for being journaled by separate ones of the housing holes 284, 384. By this arrangement, the operator members 190 are permitted to move independently relative to each other so that the opposed, wing-like arm portions 688 that form parts of each of the operator members 190 can be brought separately into engagement with the selected slide embodiment 170, 170' to effect unlatching movement of the selected slide embodiment 170, 170' in opposition to the action of the torsion coil spring 175.

The hub portions 684 of the operator members 190 each have relatively square connection formations 690 that are defined therein so as to permit each of the operator members 190 to be "operated" by a separate control linkage (such as the handle-operated linkages 74, 75 that are depicted in FIG. 2 wherein each of the bell-crank members 84, 85 is intended to be connected in a conventional manner to a separate one of the lock operator members 190, for example by suitable stub shaft formations, not shown).

Referring briefly to FIGS. 12 and 13, a preferred form of keeper 900 for use with the lock assembly 100 is formed as a one-piece casting that has a mounting flange 902 that is provided near opposite ends thereof with slotted holes 904 for receiving fasteners (not shown) to mount the keeper 900 on suitable parts of a door frame or other structure so as to be duly engaged by an associated one of the lock assemblies 100 when a closure on which the lock assembly 100 is mounted is moved to a closed position.

Projecting in cantilever fashion from a center portion of the mounting flange 902 is a toothed-surface type of latch-engaging formation that is indicated generally by the numeral 906. The formation 906 has a relatively thin rearwardly-extending web 908, tapered frontal surface portions 910, and two pairs of tooth-like formations 912 that are located intermediate the rearwardly-extending web 908 and the tapered frontal portions 910.

When the lock assembly 100 is moved into latching engagement with the keeper 900, the tapered distal end regions 160 of the latch members 150 are brought into abutting engagement with the tapered frontal surface portions 910 and are thereby caused to be wedged apart (i.e., the latch members 150 are caused to retract into the passages 700 as the tapered distal end regions 160 of the latch members 150 ride across the pairs of tooth-like formations 912, with the distal end regions 160 preferably coming to a final position of latched engagement at a location behind the tooth-like formations 912 wherein the end regions 160 extend substantially into gripping relationship with the rearwardly-extending web 908.

While the keeper 900 that is depicted in FIGS. 12 and 13 embodies the preferred form of keeper for use with the lock assembly 100, those who are skilled in the art will readily understand that a wide range of other keeper configurations can be used with the lock assembly 100.

In view of the biasing action of the springs 175, 195, the latch members 150 and other components of the lock assembly 100 normally assume the positions that are depicted in FIG. 6. When the lock assembly components are in the positions that are shown in FIG. 6, the tapered, distal end regions 160 of the latch members 150 are ready to engage a suitably configured keeper 900 in the manner that has been described. Moreover, when the lock assembly 100 has been brought into properly latched engagement with a suitably configured keeper, such as the aforedescribed keeper 900 (whereby, for example, the rearwardly extending web 908 of the keeper 900 is positioned between the distal ends 160 of the latch members 150), the latched positions of the components of the lock assembly 100 also corresponds to the component positions that are depicted in FIG. 6.

When either one of the operator members 190 is rotated to an unlatching position (to effect corresponding movements of the associated slide embodiment 170 or 170' and to effect unlatching movements of the latch members 150 such as is depicted in FIG. 14), the distal ends 160 of the latch members 150 retract into the opposed passages 700 so as to release their engagement with the keeper 900, and so as to permit the keeper 900 to be fully withdrawn from the keeper-receiving passage 800. By this method, the lock assembly 100 is caused to "unlatch."

While the described slide embodiments 170, 170' are essentially of "interchangeable" character, one advantage that does obtain with the use of the two-piece slide embodiment 170 (that does not obtain with the one-piece slide embodiment 170') is that the U-shaped clip portion 590 of the smaller component 174 serves to reinforce the bridging wall portion 502 of the larger component 172—whereby, if excessive force is caused to be applied by forcing one of the winged end regions 688 of one of the lock operators 190 into engagement with the reinforced bridging wall portion 502, the two-piece slide embodiment 170 may tend to better resist such an application of force and may therefore tend to enhance the force-resistant nature of the lock assembly 100.

As will be apparent from the foregoing discussion taken in conjunction with the accompanying drawings and the claims that follow, the present invention provides a novel and improved lock assembly that not only draws upon some of the proven features which form the subject matter of the referenced Prior Utility and Prior Design patents, but also provides a lock assembly that can be fabricated utilizing a lesser number of complexly configured components, and that makes good use of a number of components that are formed relatively simply as stampings from sheet metal.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A lock assembly, comprising:

a) housing means including first and second housing members having wall portions thereof that extend in spaced, substantially parallel planes for defining a hollow housing interior that is bounded at least in part by formation means for protectively housing and operably mounting selected operating components of the lock assembly within the hollow interior, with the housing means having first and second end regions thereof that are spaced one from the other along an imaginary center plane that extends substantially centrally through the hollow interior and substantially perpendicular to said spaced parallel planes, with the housing means including passage-defining means located near said first end region for defining a keeper-receiving passage that extends along an imaginary passage axis that extends within the center plane and extends substantially perpendicular to said spaced parallel planes, with the keeper-receiving passage being configured to receive portions of a keeper therein when the housing means and the keeper portions are moved relatively toward each other, with the passage-defining means including opposed first and second wall portions that face toward each other and extend along opposite sides of said passage axis and along opposite sides of said center plane so as to be located substantially symmetrically about the center plane, with the passage-defining means also defining opposed first and second latch-member-receiving passages that open through the opposed first and second wall portions into opposite sides of the keeper-receiving passage, with the housing means including lock operator mounting means located near said second end region for mounting lock operator means for rotation about a lock operator axis that extends within the center plane and extends substantially perpendicular to the spaced parallel planes, and with said wall portions of the housing means cooperating to define said hollow housing interior such that it includes first and second communicating portions that are adjacent to each other but are located on opposite sides of said center plane, with the first and second communicating portions cooperating to define a common central chamber that extends from a first end region thereof to a second end region thereof in a manner that is substantially symmetrical in configuration with respect to said center plane, with the housing means having opposed pairs of guide surfaces extending in parallel, end-to-end directions and being arranged symmetrically about the center plane so as to provide slide-guide surfaces at various locations within the central chamber, with the first and second latch-member-receiving passages opening into the first end region of said first and second portions of the central chamber, respectively, to thereby communicate the keeper-receiving passage with a first end region of the central chamber, and with the lock operator mounting means including aligned holes formed through the first and second housing members and opening into the second end region of the central chamber;

b) operating component means connected to the housing means and having at least portions thereof that are protectively housed by the central chamber, including:

i) first and second latch members pivotally connected to the housing means for movement about parallel pivot axes that are spaced equidistantly from the center plane but are located on opposite sides thereof within the first end region of the central chamber, with the latch members each having a base portion that extends from the location of the associated pivot axis in a direction extending away from said center plane toward an associated abutment location with the abutment locations being near opposite peripheral portions of the first end region of the central chamber, and with the latch members having abutment formations connected thereto at said abutment locations, with the latch members also having oppositely curved hook-shaped latching formations that extend away from the base portions and into the latch-member-receiving passages, and with the latch members also having keeper engagement formation means defined on distal end regions of the latching formations for releasably latchingly engaging keeper portions that may be positioned so as to extend into the keeper-receiving passage;

ii) latch member biasing means interposed between the housing means and the first and second latch members for biasing the latch members oppositely about their associated pivot axes to bias the keeper engagement formations toward each other so as to extend into latching engagement with such keeper portions as may be positioned to extend into the keeper-receiving passage;

iii) slide means slidably supported within the central chamber of the housing means and having abutment means connected thereto for extending into the first end region of the central chamber for abuttingly engaging the abutment formations of the latch members for concurrently pivoting the first and second latch members in opposite directions about their associated pivot axes to effect "unlatching" movement of the first and second latch members from engagement with such keeper portions as may be positioned to extend into the keeper-receiving passage, with the aforesaid unlatching movement serving to retract the keeper engagement formation means into the latch-member-receiving passages to release their engagement with such keeper portions as may be positioned to extend into the keeper-receiving passage, with said "unlatching" movement of the latch members resulting from sliding type of corresponding unlatching movement executed by the slide means being moved within the central chamber in a direction extending away from the first end region thereof and toward the second end region thereof, and with the slide means having first driving formation means that extends transversely within the second end region of the central chamber a location near said lock operator axis;

iv) slide biasing means interposed between the housing means and the slide means for biasing the slide means away from the second end region of the central chamber and toward the first end region of the central chamber so that said sliding type of unlatching movement of the slide means is opposed by the slide biasing means;

v) lock operator means pivotally connected to the housing means for pivoting about the lock operator axis, with the lock operator means having second drive formation means for extending into said second end region of the housing means and into driving engagement with the first driving formation means for effecting unlatching movement of the slide means in response to pivotal unlatching movement of the lock operator means about said lock operator axis;

c) said slide means includes a sheet metal stamping that is characterized by a generally U-shaped configuration that is symmetric about the center plane in that it includes first and second leg formations that are mirror images of each other, that define a plurality of edge surface formations for extending into sliding engagement with said slide-guide surfaces at said various locations within the central chamber, that have oppositely extending foot-like formation means that are located within the first end region of the central chamber for defining said abutment formation means, and that extend into the second end region of the central chamber where the first and second leg formations join with an integrally-formed bridging leg that extends transversely through the second end region of the central chamber so as to cross the center plane relatively near to the lock operator axis, with the bridging leg being configured to define at least a portion of the first driving formation means, with the first and second leg formations being substantially flat and extending in a substantially common plane that parallels said spaced, substantially parallel planes of the housing means except that, at locations midway along the lengths of the first and second leg formations, a first pair of upwardly turned, tab-like formations is provided for engaging the slide biasing means, and a second pair of upwardly turned, tab-like formations is provided for enhancing the area of contact between said edge surfaces of the first and second leg formations and a selected pair of said opposed slide-guide surfaces, and with the bridging leg extending in a plane that is substantially perpendicular to said common plane so as to define a relatively flat, thin bridging leg that is drivingly engaged by the lock operator means to effect unlatching movement of the slide means in response to pivotal movement of the lock operator means about the lock operator axis, with the thin, flat bridging leg defining a pair of opposed, substantially flat surfaces on opposite sides thereof that extend substantially perpendicular to said common plane; and, d) said slide means additionally includes reinforcing means connected to the bridging leg for extending into juxtaposition with at least one of the pair of opposed, substantially flat surfaces of the bridging leg for reinforcing and for enhancing the strength of the bridging leg.

2. The lock assembly of claim 1 wherein the slide means and the reinforcing means all comprise integral portions of the same one-piece member formed as a stamping from sheet metal.

3. The lock assembly of claim 1 wherein the slide means and the reinforcing means comprise separately formed, snap-together components stamped from sheet metal.

4. The lock assembly of claim 3 wherein the component that forms said reinforcing means provides gripping of U-shaped cross-section that is configured so as to snugly sandwich major portions of the bridging leg between overlying surfaces of the U-shaped gripping means.

5. The lock assembly of claim 1 wherein:

a) the housing means has an end wall portion that bounds the second end region of the central chamber at a location near the center plane;

b) the reinforcing means includes sheet metal structure that joins with but extends away from the U-shaped bridging leg toward said end wall portion; and, c) a stop surface is defined by said sheet metal structure for engaging said end wall portion when the slide means is at the full limit of its range of unlatching movement.

6. A lock assembly, comprising:

a) housing means including first and second housing members having wall portions thereof that extend in spaced, substantially parallel planes for defining a hollow housing interior that is bounded at least in part by formation means for protectively housing and operably mounting selected operating components of the lock assembly within the hollow interior, with the housing means having first and second end regions thereof that are spaced one from the other along an imaginary center plane that extends substantially centrally through the hollow interior and substantially perpendicular to said spaced parallel planes, with the housing means including passage-defining means located near said first end region for defining a keeper-receiving passage that extends along an imaginary passage axis that extends within the center plane and extends substantially perpendicular to said spaced parallel planes, with the keeper-receiving passage being configured to receive portions of a keeper therein when the housing means and the keeper portions are moved relatively toward each other, with the passage-defining means including opposed first and second wall portions that face toward each other and extend along opposite sides of said passage axis and along opposite sides of said center plane so as to be located substantially symmetrically about the center plane, with the passage-defining means also defining opposed first and second latch-member-receiving passages that open through the opposed first and second wall portions into opposite sides of the keeper-receiving passage, with the housing means including lock operator mounting means located near said second end region for mounting lock operator means for rotation about a lock operator axis that extends within the center plane and extends substantially perpendicular to the spaced parallel planes, and with said wall portions of the housing means cooperating to define said hollow housing interior such that it includes first and second communicating portions that are adjacent to each other but are located on opposite sides of said center plane, with the first and second communicating portions cooperating to define a common central chamber that extends from a first end region thereof to a second end region thereof in a manner that is substantially symmetrical in configuration with respect to said center plane, with the housing means having opposed pairs of guide surfaces extending in parallel, end-to-end directions and being arranged symmetrically about the center plane so as to provide slide-guide surfaces at various locations within the central chamber, with the first and second latch-member-receiving passages opening into the first end region of said first and second portions of the central chamber, respectively, to thereby communicate the keeper-receiving passage with a first end region of the central chamber, and with the lock operator mounting means including aligned holes formed through the first and second housing members and opening into the second end region of the central chamber;

b) operating component means connected to the housing means and having at least portions thereof that are protectively housed by the central chamber, including:

i) first and second latch members pivotally connected to the housing means for movement about parallel pivot axes that are spaced equidistantly from the center plane but are located on opposite sides thereof within the first end region of the central chamber, with the latch members each having a base portion that extends from the location of the associated pivot axis in a direction extending away from said center plane toward an associated abutment location with the abutment locations being near opposite peripheral portions of the first end region of the central chamber, and with the latch members having abutment formations connected thereto at said abutment locations, with the latch members also having oppositely curved hook-shaped latching formations that extend away from the base portions and into the latch-member-receiving passages, and with the latch members also having keeper engagement formation means defined on distal end regions of the latching formations for releasably latchingly engaging keeper portions that may be positioned so as to extend into the keeper-receiving passage;

ii) latch member biasing means interposed between the housing means and the first and second latch members for biasing the latch members oppositely about their associated pivot axes to bias the keeper engagement formations toward each other so as to extend into latching engagement with such keeper portions as may be positioned to extend into the keeper-receiving passage;

iii) slide means slidably supported within the central chamber of the housing means and having abutment means connected thereto for extending into the first end region of the central chamber for abuttingly engaging the abutment formations of the latch members for concurrently pivoting the first and second latch members in opposite directions about their associated pivot axes to effect "unlatching" movement of the first and second latch members from engagement with such keeper portions as may be positioned to extend into the keeper-receiving passage, with the aforesaid unlatching movement serving to retract the keeper engagement formation means into the latch-member-receiving passages to release their engagement with such keeper portions as may be positioned to extend into the keeper-receiving passage, with said "unlatching" movement of the latch members resulting from sliding type of corresponding unlatching movement executed by the slide means being moved within the central chamber in a direction extending away from the first end region thereof and toward the second end region thereof, and with the slide means having first driving formation means that extends transversely within the second end region of the central chamber a location near said lock operator axis;

iv) slide biasing means interposed between the housing means and the slide means for biasing the slide means away from the second end region of the central chamber and toward the first end region of the central chamber so that said sliding type of unlatching movement of the slide means is opposed by the slide biasing means;

v) lock operator means pivotally connected to the housing means for pivoting about the lock operator axis, with the lock operator means having second drive formation means for extending into said second end region of the housing means and into driving engagement with the first driving formation means for effecting unlatching movement of the slide means in response to pivotal unlatching movement of the lock operator means about said lock operator axis;

c) said slide means is defined, at least in part, by a sheet metal stamping that has a generally U-shaped configuration that is symmetric about the center plane in that it includes first and second leg formations that are mirror images of each other, that define a plurality of edge surface formations for extending into sliding engagement with said slide-guide surfaces at said various locations within the central chamber, that have oppositely extending foot-like formation means that are located within the first end region of the central chamber for defining said abutment formation means, and that extend into the second end region of the central chamber where the first and second leg formations join with an integrally-formed bridging leg that extends transversely through the second end region of the central chamber so as to cross the center plane relatively near to the lock operator axis;

d) said bridging leg is relatively thin and flat, extends in a plane that is substantially perpendicular to said common plane, and defines a first and second opposed, substantially flat surfaces on opposite sides thereof that extend substantially perpendicular to said common plane, with the first of said flat surfaces being positioned to be drivingly engaged by the lock operator means for effecting unlatching movement of the slide means in response to pivotal movement of the lock operator means about the lock operator axis; and, e) said slide means additionally includes reinforcing means connected to the bridging leg for extending into supporting engagement with at least the second of the pair of opposed, substantially flat surfaces of the bridging leg for reinforcing and enhancing the strength of the bridging leg.

7. The lock assembly of claim 6 wherein the first and second leg formations are substantially flat and extend in a substantially common plane that parallels said spaced, substantially parallel planes of the housing means except that, at locations midway along the lengths of the first and second leg formations, a pair of upwardly turned, tab-like formations is provided for engaging the slide biasing means.

8. The lock assembly of claim 6 wherein the first and second leg formations are substantially flat and extend in a substantially common plane that parallels said spaced, substantially parallel planes of the housing means except that, at locations midway along the lengths of the first and second leg formations, a pair of upwardly turned, tab-like formations is provided for enhancing the area of contact between said edge surfaces of the first and second leg formations and a selected pair of said opposed slide-guide surfaces.

9. The lock assembly of claim 6 wherein the the slide means and the reinforcing means all comprise integral portions of the same one-piece member formed as a stamping from sheet metal.

10. The lock assembly of claim 6 wherein the slide means and the reinforcing means comprise separately formed, snap-together components stamped from sheet metal.

11. A lock assembly, comprising:

a) housing means including first and second housing members having wall portions thereof that extend in spaced, substantially parallel planes for defining a hollow housing interior that is bounded at least in part by formation means for protectively housing and operably mounting selected operating components of the lock assembly within the hollow interior, with the housing means having first and second end regions thereof that are spaced one from the other along an imaginary center plane that extends substantially centrally through the hollow interior and substantially perpendicular to said spaced parallel planes, with the housing means including passage-defining means located near said first end region for defining a keeper-receiving passage that extends along an imaginary passage axis that extends within the center plane and extends substantially perpendicular to said spaced parallel planes, with the keeper-receiving passage being configured to receive portions of a keeper therein when the housing means and the keeper portions are moved relatively toward each other, with the passage-defining means including opposed first and second wall portions that face toward each other and extend along opposite sides of said passage axis and along opposite sides of said center plane so as to be located substantially symmetrically about the center plane, with the passage-defining means also defining opposed first and second latch-member-receiving passages that open through the opposed first and second wall portions into opposite sides of the keeper-receiving passage, with the housing means including lock operator mounting means located near said second end region for mounting lock operator means for rotation about a lock operator axis that extends within the center plane and extends substantially perpendicular to the spaced parallel planes, and with said wall portions of the housing means cooperating to define said hollow housing interior such that it includes first and second communicating portions that are adjacent to each other but are located on opposite sides of said center plane, with the first and second communicating portions cooperating to define a common central chamber that extends from a first end region thereof to a second end region thereof in a manner that is substantially symmetrical in configuration with respect to said center plane, with the housing means having opposed pairs of guide surfaces extending in parallel, end-to-end directions and being arranged symmetrically about the center plane so as to provide slide-guide surfaces at various locations within the central chamber, with the first and second latch-member-receiving passages opening into the first end region of said first and second portions of the central chamber, respectively, to thereby communicate the keeper-receiving passage with a first end region of the central chamber, and with the lock operator mounting means including aligned holes formed through the first and second housing members and opening into the second end region of the central chamber;

b) operating component means connected to the housing means and having at least portions thereof that are protectively housed by the central chamber, including:

i) first and second latch members pivotally connected to the housing means for movement about parallel pivot axes that are spaced equidistantly from the center plane but are located on opposite sides thereof within the first end region of the central chamber, with the latch members each having a base portion that extends from the location of the associated pivot axis in a direction extending away from said center plane toward an associated abutment location with the abutment locations being near opposite peripheral portions of the first end region of the central chamber, and with the latch members having abutment formations connected thereto at said abutment locations, with the latch members also having oppositely curved hook-shaped latching formations that extend away from the base portions and into the latch-member-receiving passages, and with the latch members also having keeper engagement formation means defined on distal end regions of the latching formations for releasably latchingly engaging keeper portions that may be positioned so as to extend into the keeper-receiving passage;

ii) latch member biasing means interposed between the housing means and the first and second latch members for biasing the latch members oppositely about their associated pivot axes to bias the keeper engagement formations toward each other so as to extend into latching engagement with such keeper portions as may be positioned to extend into the keeper-receiving passage;

iii) slide means slidingly supported within the central chamber of the housing means and having abutment means connected thereto for extending into the first end region of the central chamber for abuttingly engaging the abutment formations of the latch members for concurrently pivoting the first and second latch members in opposite directions about their associated pivot axes to effect "unlatching" movement of the first and second latch members from engagement with such keeper portions as may be positioned to extend into the keeper-receiving passage, with the aforesaid unlatching movement serving to retract the keeper engagement formation means into the latch-member-receiving passages to release their engagement with such keeper portions as may be positioned to extend into the keeper-receiving passage, with said "unlatching" movement of the latch members resulting from sliding type of corresponding unlatching movement executed by the slide means being moved within the central chamber in a direction extending away from the first end region thereof and toward the second end region thereof, and with the slide means having first driving formation means that extends transversely within the second end region of the central chamber a location near said lock operator axis;

iv) slide biasing means interposed between the housing means and the slide means for biasing the slide means away from the second end region of the central chamber and toward the first end region of the central chamber so that said sliding type of unlatching movement of the slide means is opposed by the slide biasing means;

v) lock operator means pivotally connected to the housing means for pivoting about the lock operator axis, with the lock operator means having second drive formation means for extending into said second end region of the housing means and into driving engagement with the first driving formation means for effecting unlatching movement of the slide means in response to pivotal unlatching movement of the lock operator means about said lock operator axis;

c) said slide means includes a sheet metal stamping that is characterized by a generally U-shaped configuration that is symmetric about the center plane in that it includes first and second leg formations that are mirror images of each other, that define a plurality of edge surface formations for extending into sliding engagement with said slide-guide surfaces at said various locations within the central chamber, that have oppositely extending foot-like formation means that are located within the first end region of the central chamber for defining said abutment formation means, and that extend into the second end region of the central chamber where the first and second leg formations join with an integrally-formed bridging leg that extends transversely through the second end region of the central chamber so as to cross the center plane relatively near to the lock operator axis, with the bridging leg being configured to define at least a portion of the first driving formation means, with the first and second leg formations being substantially flat and extending in a substantially common plane that parallels said spaced, substantially parallel planes of the housing means except that, at locations midway along the lengths of the first and second leg formations, a first pair of upwardly turned, tab-like formations is provided for engaging the slide biasing means, and a second pair of upwardly turned, tab-like formations is provided for enhancing the area of contact between said edge surfaces of the first and second leg formations and a selected pair of said opposed slide-guide surfaces, and with the bridging leg extending in a plane that is substantially perpendicular to said common plane so as to define a relatively flat, thin bridging leg that is drivingly engaged by the lock operator means to effect unlatching movement of the slide means in response to pivotal movement of the lock operator means about the lock operator axis;

d) additionally including reinforcing means connected to the bridging leg for enhancing the strength of the bridging leg; and, e) wherein the slide means and the reinforcing means comprise separately formed, snap-together components stamped from sheet metal.

12. A lock assembly, comprising:

a) housing means including first and second housing members having wall portions thereof that extend in spaced, substantially parallel planes for defining a hollow housing interior that is bounded at least in part by formation means for protectively housing and operably mounting selected operating components of the lock assembly within the hollow interior, with the housing means having first and second end regions thereof that are spaced one from the other along an imaginary center plane that extends substantially centrally through the hollow interior and substantially perpendicular to said spaced parallel planes, with the housing means including passage-defining means located near said first end region for defining a keeper-receiving passage that extends along an imaginary passage axis that extends within the center plane and extends substantially perpendicular to said spaced parallel planes, with the keeper-receiving passage being configured to receive portions of a keeper therein when the housing means and the keeper portions are moved relatively toward each other, with the passage-defining means including opposed first and second wall portions that face toward each other and extend along opposite sides of said passage axis and along opposite sides of said center plane so as to be located substantially symmetrically about the center plane, with the passage-defining means also defining opposed first and second latch-member-receiving passages that open through the opposed first and second wall portions into opposite sides of the keeper-receiving passage, with the housing means including lock operator mounting means located near said second end region for mounting lock operator means for rotation about a lock operator axis that extends within the center plane and extends substantially perpendicular to the spaced parallel planes, and with said wall portions of the housing means cooperating to define said hollow housing interior such that it includes first and second communicating portions that are adjacent to each other but are located on opposite sides of said center plane, with the first and second communicating portions cooperating to define a common central chamber that extends from a first end region thereof to a second end region thereof in a manner that is substantially symmetrical in configuration with respect to said center plane, with the housing means having opposed pairs of guide surfaces extending in parallel, end-to-end directions and being arranged symmetrically about the center plane so as to provide slide-guide surfaces at various locations within the central chamber, with the first and second latch-member-receiving passages opening into the first end region of said first and second portions of the central chamber, respectively, to thereby communicate the keeper-receiving passage with a first end region of the central chamber, and with the lock operator mounting means including aligned holes formed through the first and second housing members and opening into the second end region of the central chamber;

b) operating component means connected to the housing means and having at least portions thereof that are protectively housed by the central chamber, including:

i) first and second latch members pivotally connected to the housing means for movement about parallel pivot axes that are spaced equidistantly from the center plane but are located on opposite sides thereof within the first end region of the central chamber, with the latch members each having a base portion that extends from the location of the associated pivot axis in a direction extending away from said center plane toward an associated abutment location with the abutment locations being near opposite peripheral portions of the first end region of the central chamber, and with the latch members having abutment formations connected thereto at said abutment locations, with the latch members also having oppositely curved hook-shaped latching formations that extend away from the base portions and into the latch-member-receiving passages, and with the latch members also having keeper engagement formation means defined on distal end regions of the latching formations for releasably latchingly engaging keeper portions that may be positioned so as to extend into the keeper-receiving passage;

ii) latch member biasing means interposed between the housing means and the first and second latch members for biasing the latch members oppositely about their associated pivot axes to bias the keeper engagement formations toward each other so as to extend into latching engagement with such keeper portions as may be positioned to extend into the keeper-receiving passage;

iii) slide means slidably supported within the central chamber of the housing means and having abutment means connected thereto for extending into the first end region of the central chamber for abuttingly engaging the abutment formations of the latch members for concurrently pivoting the first and second latch members in opposite directions about their associated pivot axes to effect "unlatching" movement of the first and second latch members from engagement with such keeper portions as may be positioned to extend into the keeper-receiving passage, with the aforesaid unlatching movement serving to retract the keeper engagement formation means into the latch-member-receiving passages to release their engagement with such keeper portions as may be positioned to extend into the keeper-receiving passage, with said "unlatching" movement of the latch members resulting from sliding type of corresponding unlatching movement executed by the slide means being moved within the central chamber in a direction extending away from the first end region thereof and toward the second end region thereof, and with the slide means having first driving formation means that extends transversely within the second end region of the central chamber a location near said lock operator axis;

iv) slide biasing means interposed between the housing means and the slide means for biasing the slide means away from the second end region of the central chamber and toward the first end region of the central chamber so that said sliding type of unlatching movement of the slide means is opposed by the slide biasing means;

v) lock operator means pivotally connected to the housing means for pivoting about the lock operator axis, with the lock operator means having second drive formation means for extending into said second end region of the housing means and into driving engagement with the first driving formation means for effecting unlatching movement of the slide means in response to pivotally unlatching movement of the lock operator means about said lock operator axis;

c) said slide means is defined, at least in part, by a sheet metal stamping;

d) wherein the bridging leg extends in a plane that is substantially perpendicular to said common plane so as to define a relatively flat, thin bridging leg that is drivingly engaged by the lock operator means to effect unlatching movement of the slide means in response to pivotal movement of the lock operator means about the lock operator axis;

e) wherein the slide means and the reinforcing means comprise separately formed, snap-together components stamped from sheet metal.

13. The lock assembly of claim 11 wherein the component that forms said reinforcing means provides gripping means of U-shaped cross-section that is configured so as to snugly sandwich major portions of the bridging leg between overlying surfaces of the U-shaped gripping means.

14. The lock assembly of claim 12 wherein the component that forms said reinforcing means provides gripping means of U-shaped cross-section that is configured so as to snugly sandwich major portions of the bridging leg between overlying surfaces of the U-shaped gripping means.

* * * * *